US011246463B2

(12) United States Patent
Xie

(10) Patent No.: US 11,246,463 B2
(45) Date of Patent: Feb. 15, 2022

(54) VACUUM CLEANER AND METHOD OF CONTROLLING A MOTOR FOR A BRUSH OF THE VACUUM CLEANER

(71) Applicant: TTI (MACAO COMMERCIAL OFFSHORE) LIMITED, Macau (MO)

(72) Inventor: Fai Zhao Hui Xie, Suzhou (CN)

(73) Assignee: Techtronic Floor Care Technology Limited, Tortola (VG)

( * ) Notice: Subject to any disclaimer, the term of this patent is extended or adjusted under 35 U.S.C. 154(b) by 178 days.

(21) Appl. No.: 15/878,501

(22) Filed: Jan. 24, 2018

(65) Prior Publication Data

US 2019/0117031 A1 Apr. 25, 2019

(30) Foreign Application Priority Data

Oct. 20, 2017 (CN) ..... 201710997069.X

(51) Int. Cl.
*A47L 9/04* (2006.01)
*A47L 9/28* (2006.01)
*A47L 9/30* (2006.01)

(52) U.S. Cl.
CPC ..... *A47L 9/2831* (2013.01); *A47L 9/0411* (2013.01); *A47L 9/0477* (2013.01); *A47L 9/2826* (2013.01); *A47L 9/2842* (2013.01); *A47L 9/2847* (2013.01); *A47L 9/2857* (2013.01); *A47L 9/30* (2013.01)

(58) Field of Classification Search
CPC ..... A47L 9/242; A47L 9/02; A47L 9/36
See application file for complete search history.

(56) References Cited

U.S. PATENT DOCUMENTS 5,243,732 A * 9/1993 Koharagi ..... A47L 9/2821 15/319
5,255,409 A * 10/1993 Fujiwara ..... A47L 9/0411 15/319
5,276,939 A * 1/1994 Uenishi ..... A47L 9/2831 15/319
5,940,927 A 8/1999 Haegermarck et al.
(Continued)

FOREIGN PATENT DOCUMENTS

CA 2224735 A1 11/1997
CA 2827182 A1 8/2012
(Continued)

OTHER PUBLICATIONS

European Patent Office Search Report for Application No. 18200242.8 dated Feb. 25, 2019, 8 pages.
(Continued)

*Primary Examiner* — Joseph J Hail
*Assistant Examiner* — Arman Milanian
(74) *Attorney, Agent, or Firm* — Michael Best & Friedrich LLP

(57) ABSTRACT

A vacuum cleaner having a surface cleaning head and a brush supported by the surface cleaning head. A control circuit operates the vacuum cleaner. The control circuit includes a motor coupled to and operable to cause movement of the brush. Also disclosed is a method of controlling a motor for a brush of a vacuum cleaner. The method includes sensing an electrical parameter related to an amount of carpet load restricting the brush and determining a pulse width modulated duty cycle value based on the electrical parameter.

18 Claims, 4 Drawing Sheets

(56) References Cited

U.S. PATENT DOCUMENTS

| | | | | |
|---|---|---|---|---|
| 6,605,156 | B1 | 8/2003 | Clark et al. | |
| 7,237,298 | B2 | 7/2007 | Reindle et al. | |
| 7,424,766 | B2 | 9/2008 | Reindle et al. | |
| 7,599,758 | B2 * | 10/2009 | Reindle | A47L 9/2821 15/3 |
| 7,823,249 | B2 | 11/2010 | Zahuranec | |
| 8,099,825 | B2 | 1/2012 | Zahuranec | |
| 8,232,755 | B2 * | 7/2012 | Jeung | H02P 6/28 318/400.26 |
| 8,508,178 | B2 | 8/2013 | Norell | |
| 8,533,902 | B2 | 9/2013 | Norell et al. | |
| 8,561,253 | B2 | 10/2013 | Clothier et al. | |
| 8,648,552 | B2 | 2/2014 | Dai | |
| 8,710,778 | B2 | 4/2014 | Clothier | |
| 8,766,572 | B2 | 7/2014 | Norell | |
| 9,225,281 | B2 | 12/2015 | Dai | |
| 9,298,171 | B2 | 3/2016 | Sung et al. | |
| 9,301,665 | B2 | 4/2016 | Clothier et al. | |
| 9,456,726 | B2 | 10/2016 | Reed et al. | |
| 2002/0056169 | A1 * | 5/2002 | Kushida | H02M 7/53873 15/319 |
| 2006/0076035 | A1 | 4/2006 | McGee | |
| 2010/0229892 | A1 * | 9/2010 | Reese | H02P 7/29 134/6 |
| 2011/0015788 | A1 | 1/2011 | Celik et al. | |
| 2012/0206078 | A1 | 8/2012 | Norell | |
| 2014/0223688 | A1 | 8/2014 | Reindle | |
| 2014/0312813 | A1 | 10/2014 | Murchie | |
| 2014/0366286 | A1 | 12/2014 | Zheng et al. | |
| 2016/0172933 | A1 | 6/2016 | Strouse | |
| 2016/0235270 | A1 | 8/2016 | Santini | |
| 2016/0309975 | A1 | 10/2016 | Lindhe et al. | |
| 2016/0374525 | A1 | 12/2016 | Reed et al. | |

FOREIGN PATENT DOCUMENTS

| | | | |
|---|---|---|---|
| CA | 2917755 | A1 | 1/2015 |
| CN | 1308915 | A | 8/2001 |
| CN | 101359856 | B | 10/2011 |
| CN | 101301186 | B | 12/2011 |
| CN | 202931242 | U | 5/2013 |
| CN | 102460941 | B | 9/2014 |
| CN | 104107012 | A | 10/2014 |
| CN | 102460940 | B | 4/2015 |
| CN | 105025770 | A | 11/2015 |
| CN | 204862968 | U | 12/2015 |
| CN | 105451624 | A | 3/2016 |
| CN | 205091616 | U | 3/2016 |
| CN | 105491932 | A | 4/2016 |
| CN | 105744872 | A | 7/2016 |
| CN | 105744873 | A | 7/2016 |
| CN | 105892457 | A | 8/2016 |
| CN | 105030147 | B | 6/2017 |
| EP | 0467347 | A1 | 1/1992 |
| EP | 0841868 | B1 | 3/2000 |
| EP | 1198192 | B1 | 4/2003 |
| EP | 2237408 | B1 | 5/2012 |
| EP | 2246969 | B1 | 10/2012 |
| EP | 2674090 | A1 | 12/2013 |
| EP | 2237409 | B1 | 6/2014 |
| EP | 2415154 | B1 | 8/2014 |
| EP | 2415155 | B1 | 12/2014 |
| EP | 2953515 | B1 | 4/2017 |
| EP | 3058860 | B1 | 6/2017 |
| GB | 2469128 | A | 10/2010 |
| GB | 2469126 | B | 11/2013 |
| GB | 2469132 | B | 1/2014 |
| GB | 2469310 | B | 1/2014 |
| GB | 2471900 | B | 1/2015 |
| GB | 2513193 | B | 6/2015 |
| GB | 2515082 | B | 10/2015 |
| GB | 2515084 | B | 10/2015 |
| WO | 9707728 | A1 | 3/1997 |
| WO | 9740734 | A1 | 11/1997 |
| WO | 0106904 | A1 | 2/2001 |
| WO | 2009105698 | A1 | 8/2009 |
| WO | 2010112924 | A2 | 10/2010 |
| WO | 2010112925 | A1 | 10/2010 |
| WO | 2012112468 | A2 | 8/2012 |
| WO | 2014124274 | A1 | 8/2014 |
| WO | 2014170638 | A1 | 10/2014 |
| WO | 2014199137 | A1 | 12/2014 |
| WO | 2014199139 | A1 | 12/2014 |
| WO | 2015006341 | A1 | 1/2015 |
| WO | 2015077588 | A1 | 5/2015 |
| WO | 2015090403 | A1 | 6/2015 |
| WO | 2016130188 | A1 | 8/2016 |

OTHER PUBLICATIONS

European Patent Office Examination Report for Application No. 18200242.8 dated Oct. 2, 2020 (7 pages).

Chinese Patent Office Action for Application No. 201710997069.X dated Apr. 6, 2021 (10 pages including statement of relevance).

* cited by examiner

VACUUM CLEANER AND METHOD OF CONTROLLING A MOTOR FOR A BRUSH OF THE VACUUM CLEANER

BACKGROUND

The invention relates to a vacuum cleaner including a surface cleaning head having a brush and motor for operating the brush.

Upright vacuum cleaners are typically used to clean floor surfaces, such as carpeting. Sometimes the carpeting can have a long pile height or other attribute providing a significant resistance to the brush of the vacuum cleaner.

SUMMARY

In one embodiment, a vacuum cleaner includes a surface cleaning head having a dirty air inlet, a brush supported by the surface cleaning head, and a control circuit to operate the vacuum cleaner. The control circuit includes a motor coupled to and operable to cause movement of the brush, a sensor to sense an electrical parameter related to an amount of carpet load restricting the brush, a comparator to determine whether the electrical parameter traverses a threshold indicative of an excess carpet load, and a switch controlled in response to the determination. The switch is controlled with a first pulse-width-modulated (PWM) duty cycle when the electrical parameter does not traverse the threshold and is controlled with a second PWM duty cycle when the electrical parameter traverses the threshold. The second PWM duty cycle is less than the first duty cycle.

In another embodiment, a vacuum cleaner is disclosed providing a method of controlling a motor for a brush of a vacuum cleaner. The method includes controlling a current of the motor to move the brush, sensing an electrical parameter related to an amount of carpet load restricting the brush, comparing the electrical parameter with a threshold indicative of an excess carpet load, and determining a pulse width modulated (PWM) duty cycle value based on the comparison of the electrical parameter with the threshold. The determination includes decreasing the PWM duty cycle value when the electrical parameter traverses the threshold, and increasing the PWM duty cycle value when the electrical parameter does not traverse the threshold. The method further includes further controlling the current of the motor with a switch based on the PWM duty cycle value.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
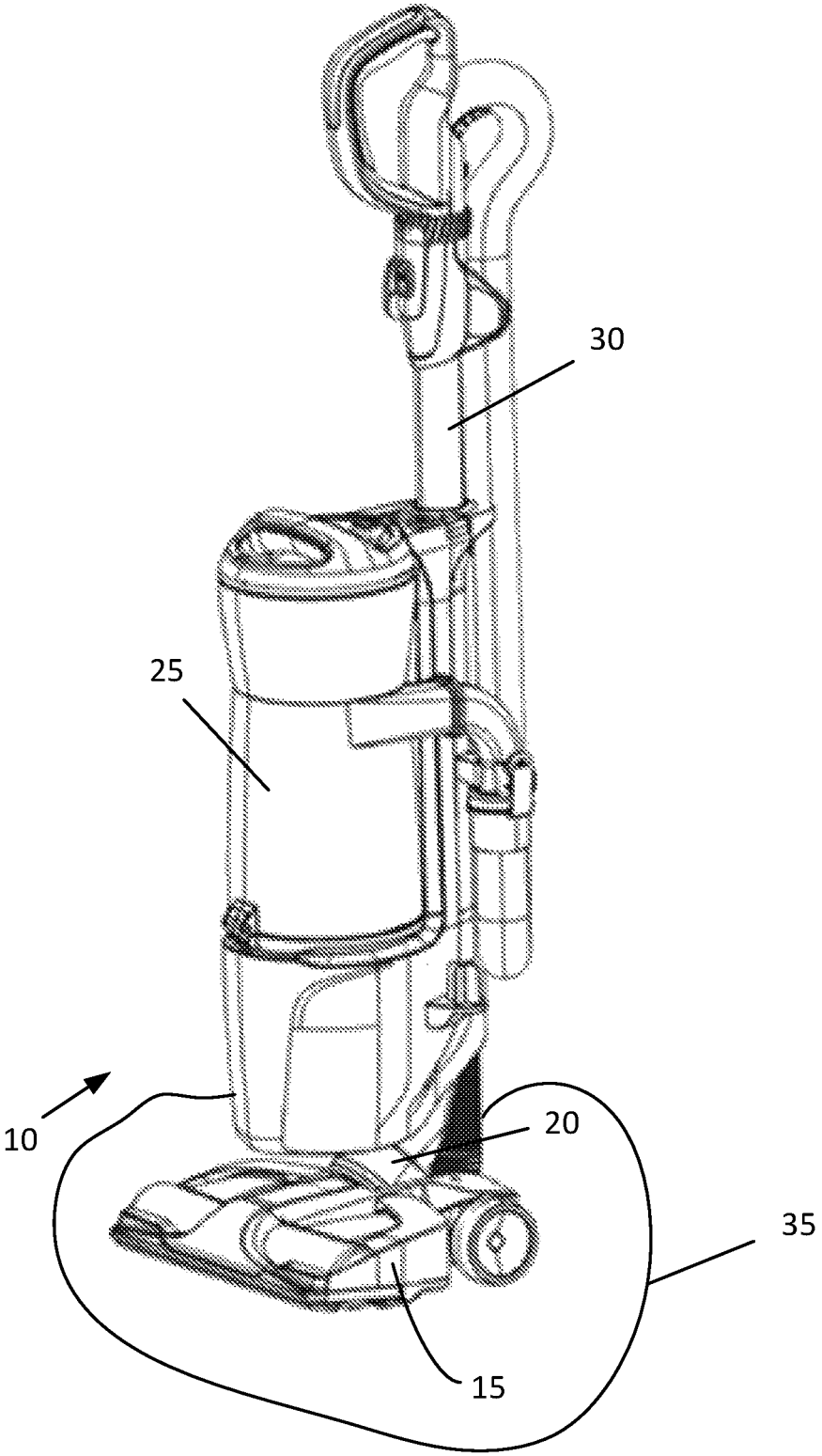
FIG. 1 is a perspective view of a vacuum cleaner according to an embodiment of the invention.

FIG. 1 illustrates an exemplary vacuum cleaner 10. The vacuum cleaner 10 includes a surface cleaning head 15, a pivot assembly 20, and a canister assembly 25. The vacuum cleaner 10 further includes an upright handle 30. The vacuum cleaner 10 shown in FIG. 1 is typically referred to as an upright vacuum cleaner. However, the invention is not limited to upright vacuum cleaners, i.e., can be used in other vacuum types for example canister vacuums, stick vacuums, and robot vacuums, and the arrangement of the upright vacuum cleaner can vary from the vacuum cleaner 10 shown in FIG. 1.

In the illustrated embodiment of FIG. 1, the surface cleaning head 15 is movable along a surface 35 to be cleaned, such as a carpeted floor. The upright handle 30 allows a user to move the surface cleaning head 15 along the surface 35. The upright handle 30 is also movable relative to the surface cleaning head 15 between an upright position (FIG. 1) and an inclined position.

Figure 2:
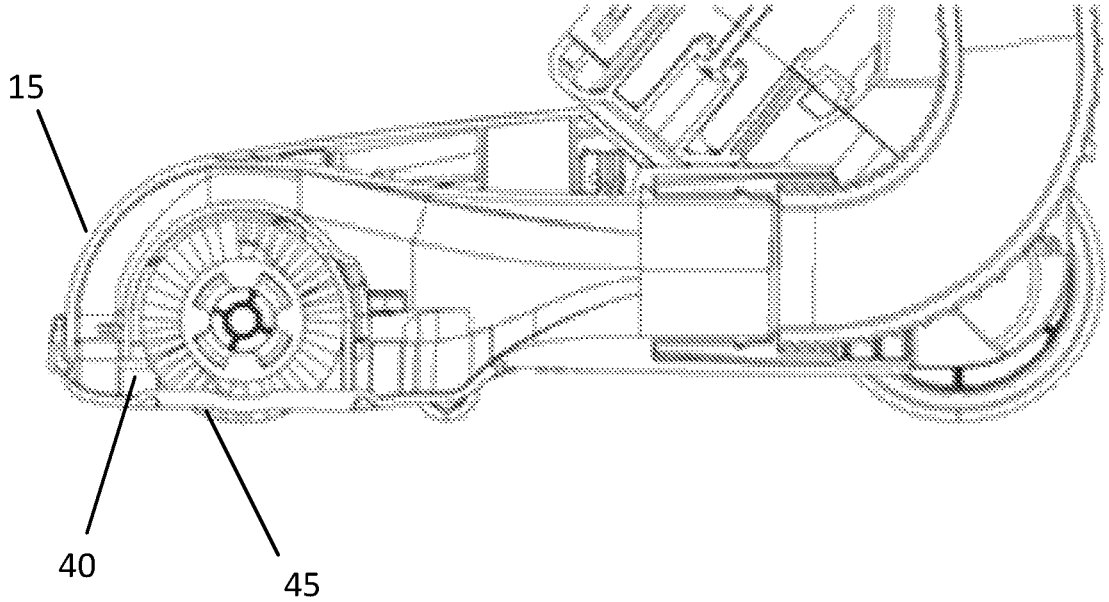
FIG. 2 is a sectional view of a portion of the vacuum cleaner of FIG. 1.

The surface cleaning head 15 includes a dirty air inlet 40 (shown in FIG. 2). The surface cleaning head further includes a brushroll (also referred to as a brush) 45 for agitating the surface 35 being cleaned. The brush 45 is driven by a brush motor 50 (shown in FIG. 3).

Figure 3:
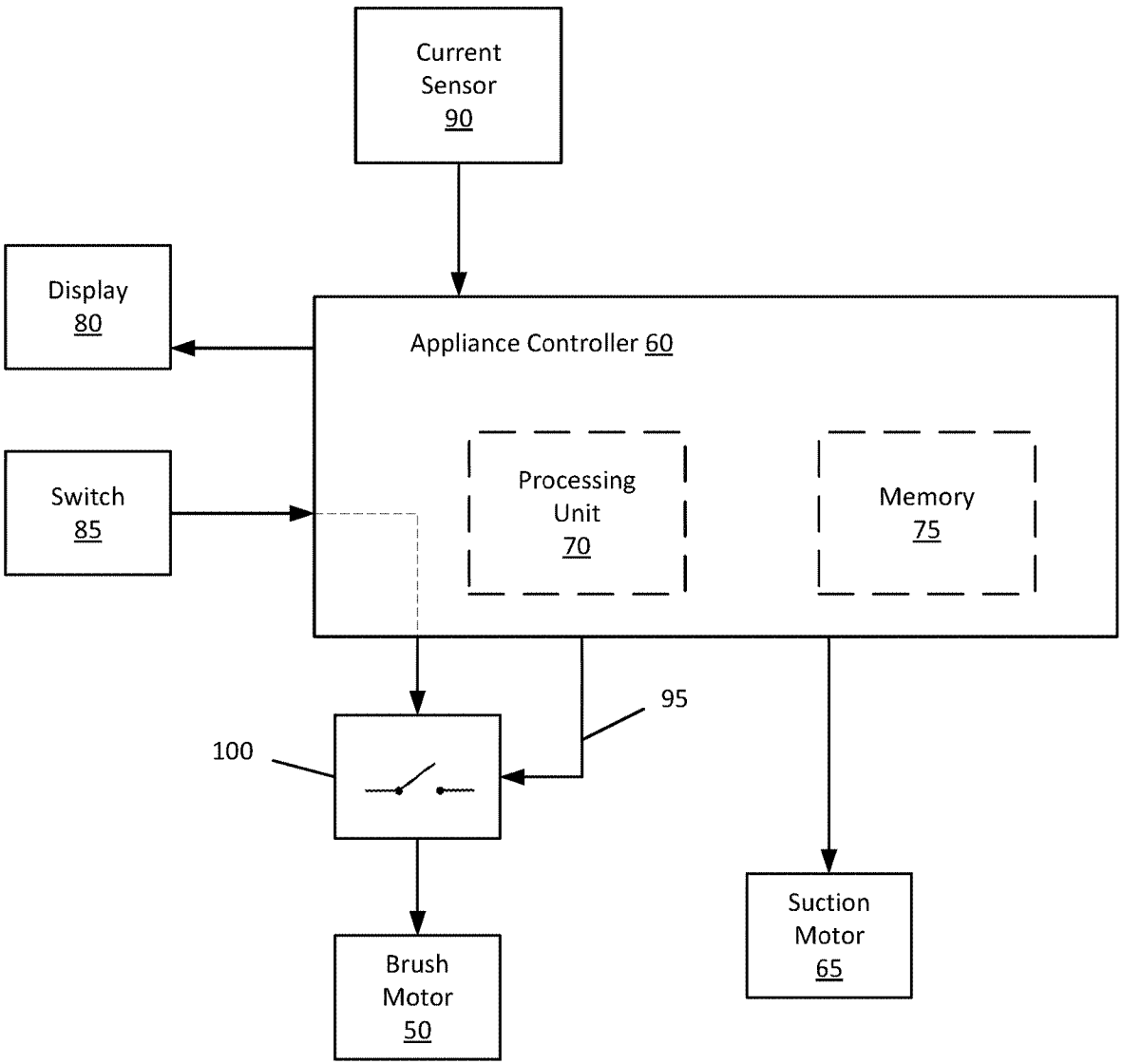
FIG. 3 is a block diagram of a portion of the control circuit for the vacuum cleaner of FIG. 1

The vacuum cleaner 10 includes other electrical components besides the brush motor 50 that are part of an appliance control circuit 55. With reference to FIG. 3, the control circuit 55 further includes an appliance controller 60, a suction motor 65, a user interface, and sensors.

The appliance controller 60 includes combinations of software and hardware that are operable to, among other things, control the operation of the vacuum 10, receive input from the sensors, receive input or provide output with the user interface, and control the motors 50 and 65.

In one construction, the appliance controller 60 includes a printed circuit board ("PCB") that is populated with a plurality of electrical and electronic components that provide, power, operational control, and protection to the vacuum 10. In some constructions, the PCB includes, for example, a processing unit 70 (e.g., a microprocessor, a microcontroller, or another suitable programmable device) and a memory 75. The memory 75 includes, for example, a read-only memory ("ROM"), a random access memory ("RAM"), an electrically erasable programmable read-only memory ("EEPROM"), a flash memory, or another suitable magnetic, optical, physical, or electronic memory device. The processing unit 70 is connected to the memory 75 and executes instructions (e.g., software) that is capable of being stored in the RAM (e.g., during execution), the ROM (e.g., on a generally permanent basis), or another non-transitory computer readable medium such as another memory or a disc. Additionally or alternatively, the memory 75 is included in the processing unit 70 (e.g., as part of a microcontroller).

Software included in this implementation of the vacuum cleaner 10 is stored in the memory 75 of the appliance controller 60. The software includes, for example, firmware, program data, one or more program modules, and other executable instructions. The appliance controller 60 is configured to retrieve from memory and execute, among other things, instructions related to the control processes and methods described herein.

The PCB also includes, among other things, a plurality of additional passive and active components such as resistors, capacitors, inductors, integrated circuits, and amplifiers. These components are arranged and connected to provide a plurality of electrical functions to the PCB including, among other things, signal conditioning or voltage regulation. For descriptive purposes, the PCB and the electrical components populated on the PCB are collectively referred to as the appliance controller 60. It should also be noted that the current sensor (discussed below), for example can be mounted on the PCB and also considered part of the appliance controller 60. However, for ease of description, the current sensor will be described separately.

The user interface is included to control the vacuum cleaner 10. The user interface can include a combination of digital and analog input devices to control the vacuum cleaner 10. For example, the user interface can include a display 80 and a switch 85, or the like. The display 80 can be as simple as LEDs indicating operation of the vacuum cleaner 10, and the switch 85 can be used for activating/deactivating the vacuum cleaner 10. The display 80 can be mounted on a PCB with other additional passive and active components necessary for controlling the display, similar to what was discussed for the appliance controller 60, or can be mounted on the PCB for the appliance controller 60.

The appliance controller 60 operates the brushroll motor 50 and the suction motor 65, the operation of which may be based on a floor type. For example, the appliance controller 60 may operate the suction motor 65 at a lower power on a hard floor surface to conserve energy or a higher power on a hard floor surface to increase debris pick-up. In some embodiments, the brushroll motor 50 may be operated at a lower power on certain height carpets to reduce the action of the brushroll 45 to the carpet and the force applied from the carpet to the brushroll, or carpet load, so that the vacuum cleaner 10 is less likely to stall, for example.

The current sensor 90 (also sometimes referred to as the brushroll sensor) refers to a sensor that senses an electrical parameter related directly or indirectly to an aspect of carpet load restricting the brush. An exemplary parameter may be the amount of current to or through the brushroll motor 50. The brushroll sensor can be a tachometer for sensing a revolutions per minute (RPM) value of the brushroll 45, a tachometer for sensing an RPM value of the brushroll motor 50, an electrical sensor (e.g., the current sensor) for sensing an electrical parameter (e.g., current or voltage) of the brushroll motor 50, a torque sensor for sensing a torque parameter of the brushroll motor 50, etc. It is envisioned that the number of sensors can be greater than the single sensor shown.

With reference to the implementation of FIG. 3, the vacuum cleaner 10 includes a current sensor 90 and an appliance controller 60 in communication with the current sensor 90. The current sensor 90 is configured to sense a parameter indicative of the current draw of the brushroll motor 50. The appliance controller 60 receives a signal from the current sensor 90 and compares the signal with a corresponding predetermined threshold. In some implementations, the appliance controller 60 includes an overload protection that will stop the brushroll motor 50 and/or vacuum cleaner operation after sensing a parameter related to an overload current (e.g., 2.3 amps in one specific example). In order to preserve the life of the brushroll motor 50 a current stall indication may be provided to the user before the overload current, or failure threshold is met. However, a load of this magnitude is possible during normal use on high pile carpet height, for example. In order to prevent the current stall from occurring, a mechanical air bleed may be provided in the suction flow path of the vacuum cleaner 10 to provide inflow of air to the vacuum through the air bleed. The user is instructed to open the mechanical bleed if they are experiencing a brushroll stall event during normal use because the inflow of air to the vacuum reduces the amount of suction at the nozzle, reducing the nozzle engagement to the carpet caused by suction. Opening of the mechanical bleed reduces both the carpet load on the brushroll 45 and also the cleaning efficiency of the vacuum cleaner 10 itself.

An alternative, or even additive, approach is to monitor the current being fed through the brushroll motor 50 and to automatically adjust via pulse width modulation (PWM) the voltage input to the brushroll motor 50. As a result of decreasing the voltage to the brushroll motor 50, the current consumption of the brushroll motor 50 will also decrease as well as the speed of the brushroll 45 itself. As a result, the brushroll motor 50 can be automatically protected without user intervention.

In FIG. 3, a control signal 95 is a PWM signal from the controller 60. When the PWM signal is high, current flows through the switch 100 to the brushroll motor 50. When the PWM signal is low, current is restricted by the switch 100. The actual average motor input voltage can be varied by adjusting the PWM signal from a maximum to a minimum duty cycle.

The current through the brushroll 50 is monitored with the current sensor 90. In one embodiment, a voltage indicative of the brushroll current is acquired from a secondary side of a transformer in a current path from the switch 85 to the brushroll motor 50. In an alternative embodiment, a voltage indicative of the brushroll current is acquired from a resistor network in a current path between the switch 85 and the brushroll motor 50. Firmware of the appliance controller 60 uses information gained from the current sensor signal to make adjustments to the control signal 95 to decrease the voltage at the motor as a result of increased current due to loading as a result of high pile carpet.

Figure 4:
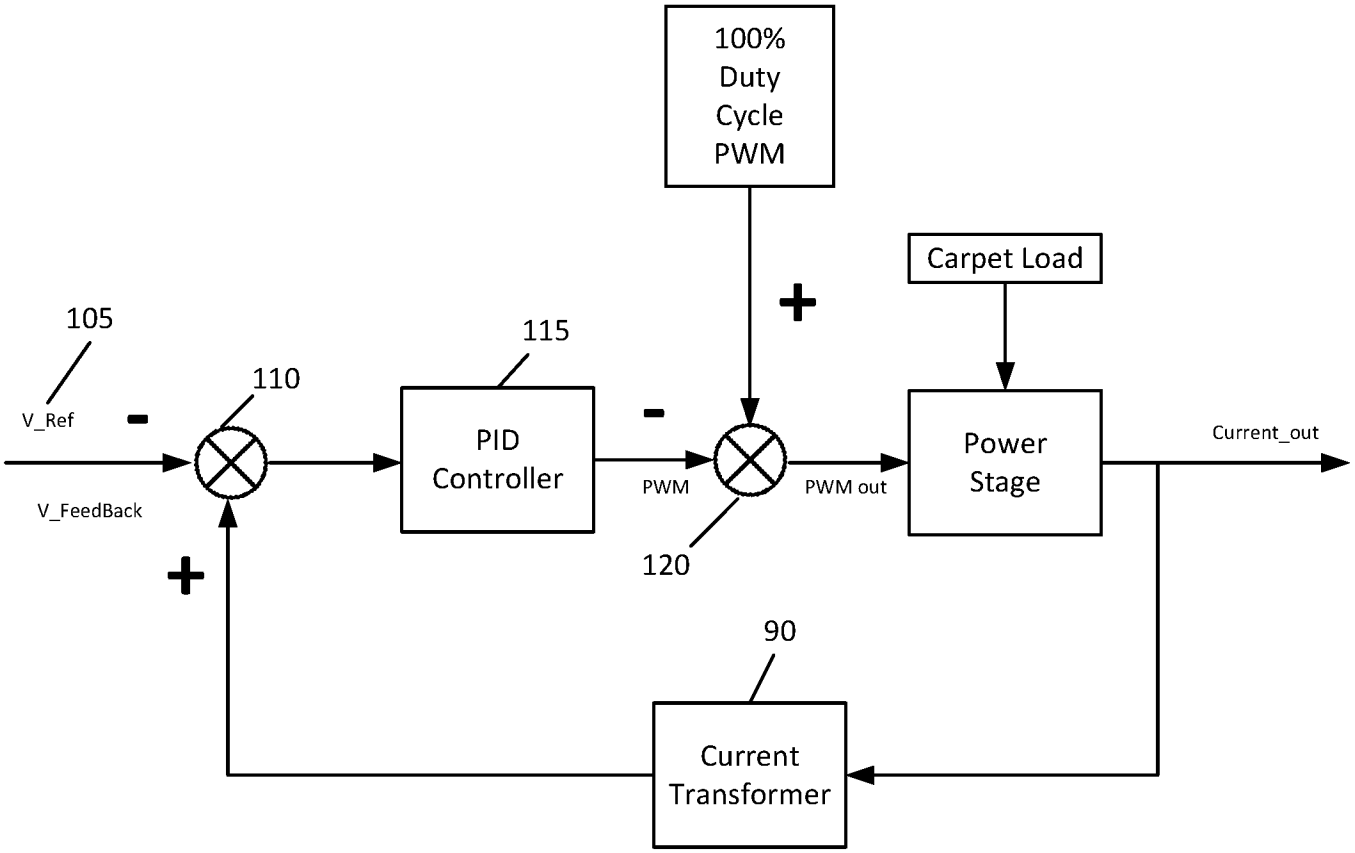
FIG. 4 is a block diagram of a portion of the firmware used to control the brush motor of the control circuit of FIG. 3.

An exemplary firmware logic is shown in FIG. 4. A reference voltage 105 is set in the firmware. The reference voltage is less than the voltage associated with the overload current and selected to extend the brushroll motor run time in desired user conditions. The reference voltage may be a voltage providing a corresponding current that is a function of the overload current, such as 80% or 85% or 90% or other function of the overload current of the brushroll motor. Alternatively or additionally, the reference voltage is empirically determined to extend the brushroll motor run time a desired amount in the user condition. In one specific example, a reference voltage associated with 2.1 Amps is the maximum voltage that an implementation allows the PWM signal to operate with 100 percent duty.

The vacuum cleaner 10 is turned on by the user with switch 85 and information is acquired via the current sensor 90. The firmware determines a difference between the current signal and the set point reference (at 110). The firmware uses a filter, such as a proportional, integral, and derivative (PID) filter 115, to filter the peaks and valleys out of the signal. If the current measurement is smaller than the reference voltage (at 120), the PWM duty cycle is increased to a PWM value. In some implementations, the PWM value is set to maximum voltage (e.g., 100 percent duty cycle). In other implementations, the PWM value is incremented by a value amount (e.g., 10 percent) until the maximum duty cycle is obtained. The PWM duty cycle typically remains at the maximum duty cycle until the voltage at the brushroll motor is equal to or larger than the reference voltage.

If the voltage associated with the brushroll current measurement is larger than the reference voltage, the PWM value is decreased to extend the brushroll motor run time before reaching the overload current. In some implementations, the PWM value is decremented by a value amount (e.g., 10 percent) until a minimum duty cycle is obtained. For example, the minimum duty cycle value may be 50 percent. In an alternative implementation, the PWM value is decremented as a function of the reference voltage until the minimum duty cycle is obtained. In yet another implementation, the duty cycle is set to a first PWM duty cycle when the voltage is smaller than the reference voltage and a second, non-zero, PWM duty cycle when the voltage is larger than the reference voltage. For example, the duty cycle may be 100% when the voltage associated with the brushroll current measurement is below the reference voltage and the duty cycle may be 50% when the voltage is above the reference voltage. If the firmware wants to reduce the PWM value to be less than the minimum duty cycle value, then a current stall indication may be displayed to the user. The brushroll motor continues to operate at the reduced PWM duty cycle value until the current sensor signal of the brushroll motor either increases to the predetermined voltage associated with the overload current or decreases to below the reference voltage. When the brushroll motor current reaches the overload current, the controller turns off the brushroll motor. When the voltage of the current sensor drops below the reference voltage, the controller increases the PWM duty cycle value. In one embodiment, when the measured voltage drops below the reference voltage, the controller determines whether the PWM duty cycle value is less than an upper limit. The upper duty cycle limit may be 100%, or may be a lower limit such as 95% or 90% or any other desired predetermined limit. If the PWM duty cycle value is less than an upper limit and the measured voltage is less than the reference voltage, the controller increases the PWM duty cycle value. The controller may increase the PWM duty cycle to the upper limit or may increase the PWM duty cycle a predetermined amount.

Accordingly, the invention provides a new and useful vacuum cleaner and method of controlling a motor for a brush of the vacuum cleaner. Various features and advantages of the invention are set forth in the following claims.

The invention claimed is:

1. A vacuum cleaner comprising:

a surface cleaning head including a dirty air inlet;

a brush supported by the surface cleaning head; and a control circuit to operate the vacuum cleaner, the control circuit including a motor coupled to and operable to cause movement of the brush, a sensor to sense a voltage associated with motor current indicative of an amount of carpet load restricting the brush, a comparator to determine whether the voltage is less than a reference voltage, the reference voltage being less than a voltage value associated with motor current indicative of an excess carpet load, and a switch for controlling an amount of current provided to the motor and controlled in response to the determination, including the switch being controlled with a first pulse-width-modulated (PWM) duty cycle when the voltage is less than the reference voltage and being controlled with a second PWM duty cycle when the voltage is greater than the reference voltage, the second PWM duty cycle being less than the first duty cycle;

wherein the switch is controlled with the second PWM duty cycle until the voltage increases to the voltage value associated with motor current indicative of an excess carpet load or the voltage decreases to below the reference voltage.

2. The vacuum cleaner of claim 1, wherein the first PWM duty cycle is a 100 percent duty cycle.

3. The vacuum cleaner of claim 1, wherein a resultant of the comparator is applied to a filter.

4. The vacuum cleaner of claim 1, wherein the controller further includes a processing unit and non-transitory memory with instructions executable by the processing unit, the instructions when executed by the processing unit include the processor unit determining whether the voltage is less than the reference voltage and generating a signal for controlling the switch.

5. The vacuum cleaner of claim 4, wherein the instructions when executed by the processing unit include the processor unit decreasing the first PWM duty cycle to the second PWM duty cycle when the voltage is greater than or equal to the reference voltage.

6. The vacuum cleaner of claim 4, wherein the instructions when executed by the processing unit include the processor unit increasing the second PWM duty cycle to the first PWM duty cycle when the voltage is less than the reference voltage.

7. The vacuum cleaner of claim 1, further comprising an LED indication when the voltage is greater than or equal to the reference voltage.

8. The vacuum cleaner of claim 1, wherein the switch is controlled with the second PWM duty cycle until the voltage increases to the voltage value associated with motor current indicative of an excess carpet load.

9. A vacuum cleaner comprising:

a surface cleaning head including a dirty air inlet;

a brush supported by the surface cleaning head; and a control circuit to operate the vacuum cleaner, the control circuit including a motor coupled to and operable to cause movement of the brush, a sensor to sense a voltage associated with motor current indicative of an amount of carpet load restricting the brush, a comparator to determine whether the voltage is less than a reference voltage, the reference voltage being less than a voltage value associated with motor current indicative of an excess carpet load, and a switch for controlling an amount of current provided to the motor and controlled with a pulse-width modulated (PWM) duty cycle in response to the determination, including the switch being controlled to:

increase the PWM duty cycle to a maximum PWM duty cycle when the voltage is less than the reference voltage, the maximum duty cycle being an upper limit for the PWM duty cycle at which the switch is controlled, and decrease the PWM duty cycle to a minimum PWM duty cycle when the voltage is greater than the reference voltage, the minimum PWM duty cycle being a non-zero lower limit for the PWM duty cycle at which the switch is controlled.

10. The vacuum cleaner of claim 9, wherein the PWM duty cycle is iteratively decremented by a value from the maximum PWM duty cycle to the minimum PWM duty when the voltage is greater than the reference voltage.

11. A vacuum cleaner comprising:

a surface cleaning head including a dirty air inlet;

a brush supported by the surface cleaning head; and a control circuit to operate the vacuum cleaner, the control circuit including a motor coupled to and operable to cause movement of the brush, a sensor to sense a voltage associated with motor current indicative of an amount of carpet load restricting the brush, a comparator to determine whether the voltage is less than a reference voltage, the reference voltage being less than a voltage value associated with motor current indicative of an excess carpet load, and a switch for controlling an amount of current provided to the motor and controlled in response to the determination, including the switch being controlled with a first pulse-width-modulated (PWM) duty cycle when the voltage is less than the reference voltage and being controlled with a second PWM duty cycle when the voltage is greater than the reference voltage, the second PWM duty cycle being less than the first duty cycle.

12. The vacuum cleaner of claim 11, wherein the first PWM duty cycle is a 100 percent duty cycle.

13. The vacuum cleaner of claim 11, wherein a resultant of the comparator is applied to a filter.

14. The vacuum cleaner of claim 11, wherein the controller further includes a processing unit and non-transitory memory with instructions executable by the processing unit, the instructions when executed by the processing unit include the processor unit determining whether the voltage is less than the reference voltage and generating a signal for controlling the switch.

15. The vacuum cleaner of claim 14, wherein the instructions when executed by the processing unit include the processor unit decreasing the first PWM duty cycle to the second PWM duty cycle when the voltage is greater than or equal to the reference voltage.

16. The vacuum cleaner of claim 14, wherein the instructions when executed by the processing unit include the processor unit increasing the second PWM duty cycle to the first PWM duty cycle when the voltage is less than the reference voltage.

17. The vacuum cleaner of claim 11, further comprising an LED indication when the voltage is greater than or equal to the reference voltage.

18. The vacuum cleaner of claim 11, wherein the switch is controlled with the second PWM duty cycle while the voltage is greater than the reference voltage and less than the voltage value associated with motor current indicative of an excess carpet load.

* * * * *